US006126493A

United States Patent [19]

Price et al.

[11] Patent Number: 6,126,493

[45] Date of Patent: Oct. 3, 2000

[54] ELECTRICAL FASTENER

[75] Inventors: Donald D. Price, Northville; Guy Faucher, Livonia, both of Mich.

[73] Assignee: Lear Corporation, Southfield, Mich.

[21] Appl. No.: 09/132,082

[22] Filed: Aug. 10, 1998

[51] Int. Cl.[7] ..... H01R 4/30

[52] U.S. Cl. ..... 439/801; 29/854; 174/87 C; 439/883

[58] Field of Search ..... 439/801, 388, 439/761, 762, 763, 877, 95, 203, 212, 100, 92, 884, 889, 98, 84; 174/84 C, 51; 29/854, 882

[56] References Cited

U.S. PATENT DOCUMENTS

| | | | |
|---|---|---|---|
| 2,324,828 | 7/1943 | Danberg | 439/801 |
| 3,644,878 | 2/1972 | Toedtman | 439/883 |
| 5,413,500 | 5/1995 | Tanaka | 439/521 |
| 5,442,133 | 8/1995 | Arnold et al. | 174/51 |
| 5,487,685 | 1/1996 | Stillback | 439/801 |
| 5,616,036 | 4/1997 | Polidori | 439/100 |
| 5,759,055 | 6/1998 | Colantuano et al. | 439/287 |
| 5,759,056 | 6/1998 | Costello et al. | 439/290 |
| 5,915,758 | 6/1999 | Alfiero | 29/854 |

*Primary Examiner*—Paula Bradley
*Assistant Examiner*—Alexander Gilman
*Attorney, Agent, or Firm*—MacMillan, Sobanski & Todd, LLC

[57] ABSTRACT

An electrical fastener forms an electrical connection with an electrically conductive surface having a threaded peg. The inventive electrical fastener includes an electrically conductive body electrically connected to an electrical wire and a threadless sleeve for attachment to the threaded peg. In a first embodiment of this invention, the electrically conductive body consists of an eyelet terminal having a plurality of tabs for locking the sleeve to the eyelet terminal. In a second embodiment of this invention, the electrically conductive body and the sleeve are of a unitary piece, preferably with the sleeve extruded or cold stamped from the body.

6 Claims, 2 Drawing Sheets

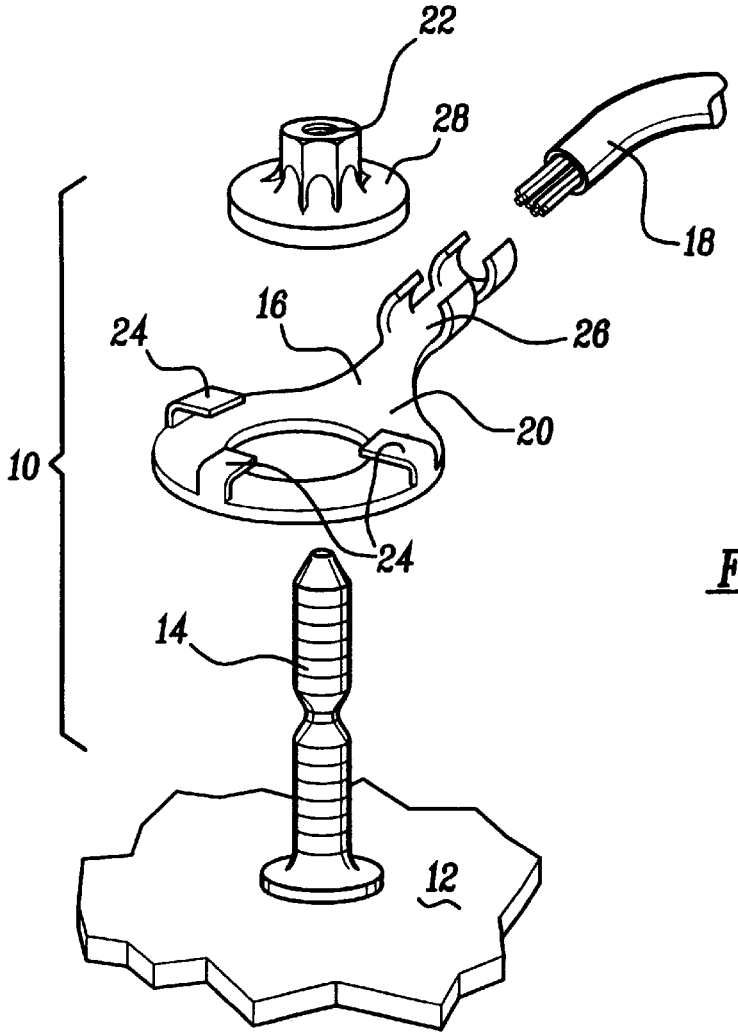
Fig-1
Fig-2
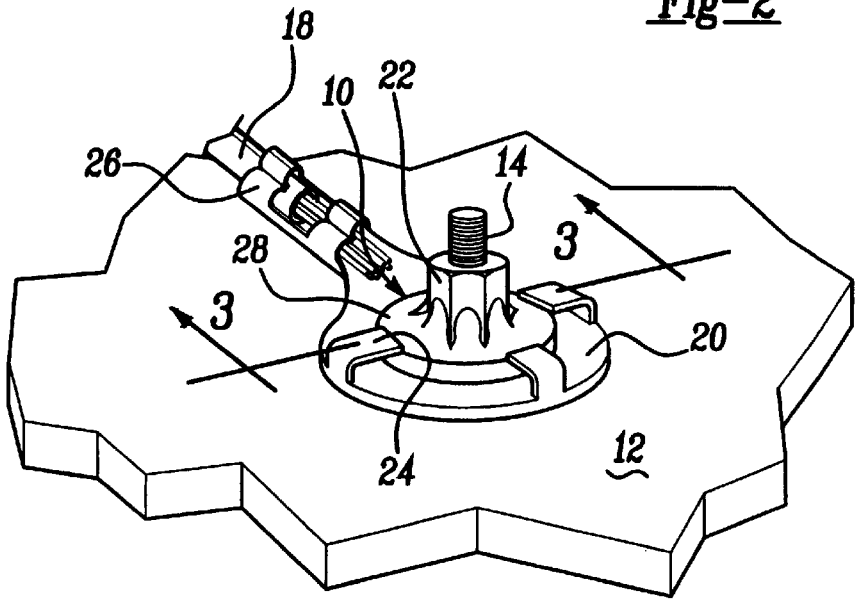

ELECTRICAL FASTENER

BACKGROUND OF THE INVENTION

This invention relates to an electrical fastener for forming an electrical connection with an electrically conductive surface having a threaded peg.

Modem vehicles include many electrical devices which require electrical grounding. As a result, vehicle wire harnesses, which supply power and ground to the electrical devices, include several ground eyelet terminals. These eyelet terminals, sometimes referred to as ring terminals, must be attached or "grounded" to an electrically conductive surface.

Typically, the eyelet terminals are either attached directly to the sheet metal of the vehicle with a self tapping screw or positioned over a metal bolt or stud and retained with a weld nut. Although these fastening methods usually provide a sufficient electrical ground, they have shortcomings. Weld nuts and self tapping screws are costly, difficult to assemble, slow to install, and prone to cross-threading.

In mechanical fastening applications, a fastening method referred to as crimped sleeve fastening ha s been used to fasten mechanical parts, such as trim pieces, to a vehicle. Crimped sleeve fastening employs a threadless sleeve which is crimped or riveted to a stud or bolt protruding from the vehicle. Crimped sleeve technology has not been used in electrical fastening applications.

SUMMARY OF THE INVENTION

In a disclosed embodiment of this invention, an electrical fastener forms an electrical connection with an electrically conductive surface having a threaded peg. The electrical fastener includes an electrically conductive body electrically connected to an electrical wire and a threadless sleeve for attachment to the threaded peg.

In a first embodiment of this invention, the electrically conductive body consists of an eyelet terminal having a plurality of tabs for locking the sleeve to the eyelet terminal. In a second embodiment of this invention, the electrically conductive body and the sleeve are of a unitary piece. Preferably, the sleeve is extruded or cold stamped from the body.

These and other features of the present invention will be best understood from the following specification and drawings, the following of which is a brief description.

BRIEF DESCRIPTION OF THE DRAWINGS

FIG. 1 is an exploded, perspective view of a first embodiment of an electrical fastener in accordance with the present invention.

FIG. 2 is a perspective view of the electrical fastener crimped to a threaded peg extending from an electrically conductive surface.

DETAILED DESCRIPTION OF THE PREFERRED EMBODIMENT

Figure 3:
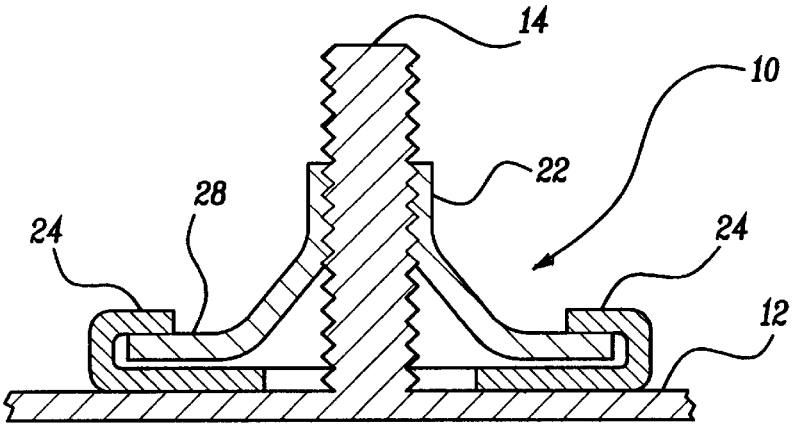
FIG. 3 is a cross-sectional view of the electrical fastener and the threaded peg taken along lines 3—3 in FIG. 2.

FIG. 1 is an exploded, perspective view of a first embodiment of an electrical fastener 10 in accordance with the present invention. The electrical fastener 10 is designed to form an electrical connection with an electrically conductive surface 12 having a threaded peg 14. In most fastening applications, the electrically conductive surface 12 consists of a piece of sheet metal, shown fragmented in FIG. 1, and the threaded peg 14 consists of a threaded bolt or threaded stud welded or otherwise attached to the sheet metal. One of ordinary skill in the art will recognize that the electrical fastener 10 is particularly adapted to form an electrical connection with the sheet metal of a vehicle.

The electrical fastener 10 includes an electrically conductive body 16 electrically connected to an electrical wire 18. In the first embodiment of the present invention, the electrically conductive body 16 is a two-piece design consisting of an eyelet or ring terminal 20 and a threadless sleeve 22. The eyelet terminal 20 includes a plurality of tabs 24 for locking the sleeve 22 to the eyelet terminal 20 and a conventional fold crimp end 26 for electrically connecting the eyelet terminal 20 and the electrical wire 18. In a preferred embodiment of the present invention, the sleeve 22 includes a retaining lip 28. In accordance with the scope of the invention, the electrical wire 18 may be a ground circuit wire, as shown in FIG. 1, or power supply circuit or lead.

FIG. 2 is a perspective view of the electrical fastener 10 crimped to the threaded peg 14 extending from the electrically conductive surface 12. FIG. 3 is a cross-sectional view of the electrical fastener 10 and the threaded peg 14 taken along lines 3—3 in FIG. 2. In accordance with the scope of the present invention, a method for forming an electrical connection between the electrical eyelet terminal 20, electrically connected to the electrical circuit 18, and the electrically conductive surface 12 having the threaded peg 14 is disclosed. The steps of the method include: providing a threadless sleeve 22; connecting the sleeve 22 and the eyelet terminal 20; installing the connected sleeve 22 and eyelet terminal 20 over the threaded peg 14 and into electrical contact with the electrically conductive surface 12; and crimping the sleeve 22 to the threaded peg 14 to hold the eyelet terminal 20 against the electrically conductive surface 12.

In a preferred method, the step of connecting the sleeve 22 and the eyelet terminal 20 consists of folding the tabs 24 of the eyelet terminal 20 over the retaining lip 28 of the sleeve 22 as shown in FIG. 2. Additionally, the step of crimping the sleeve 22 to the threaded peg 14 consists of compressing or riveting the sleeve 22 against the threaded peg 14 as shown in FIG. 3.

In a vehicle application, typically the eyelet terminal 20 is connected with the sleeve 22 and crimped to the electrical wire 18 prior to delivery of the wire harness to the assembly plant. During assembly of the vehicle, an assembler typically places the electrical fastener 10 over the threaded peg 14 and into electrical contact with the vehicle sheet metal. The assembler then crimps the sleeve 22 of the electrical fastener 10 to the threaded peg 14 with a tool known in the mechanical fastening applications described above.

Figure 4:
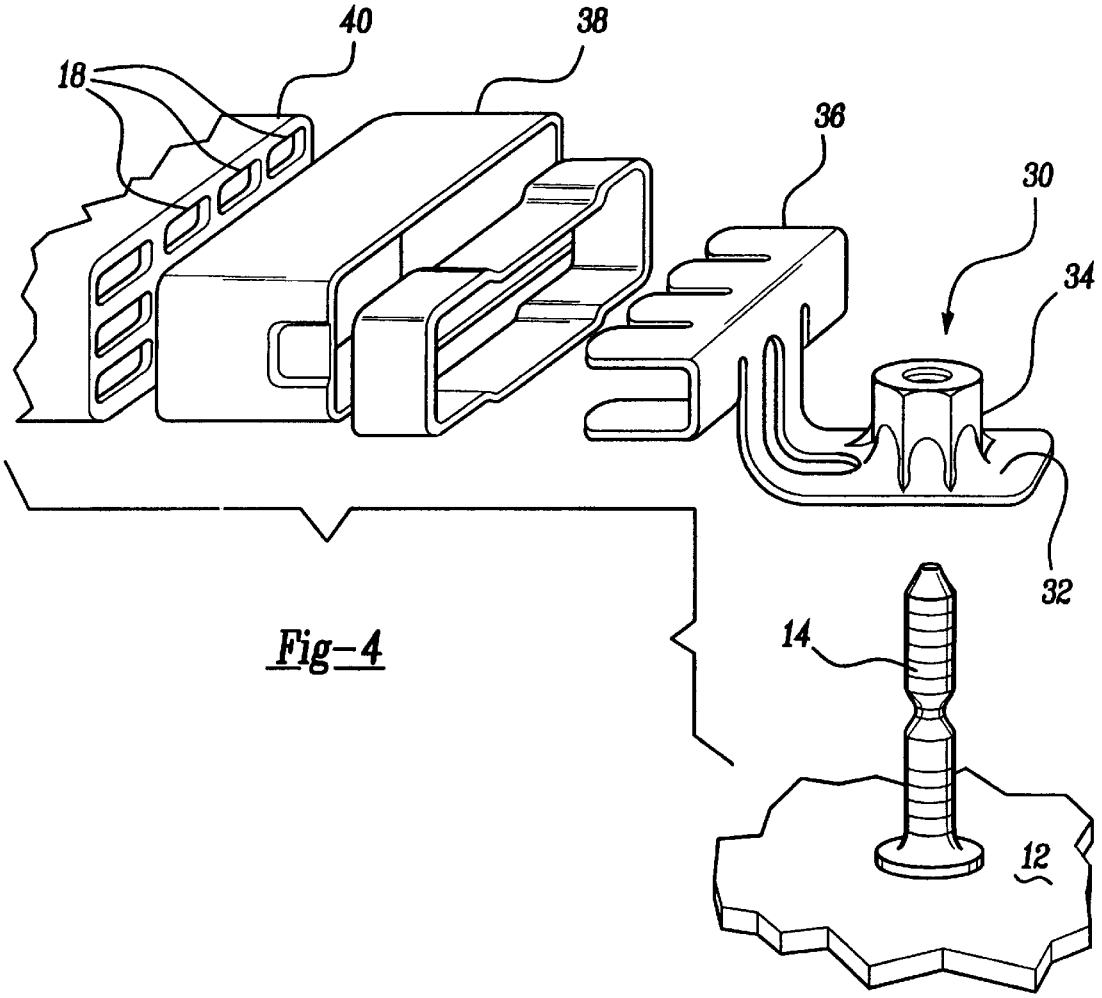
FIG. 4 is an exploded, perspective view of a second embodiment of an electrical fastener in accordance with the present invention.

FIG. 4 is an exploded, perspective view of a second embodiment of an electrical fastener 30 in accordance with the present invention. Similar to the first embodiment 10, the second embodiment electrical fastener 30 includes an electrically conductive body 32 and a threadless sleeve portion 34. Unique to the second embodiment electrical fastener 30, the electrically conductive body 32 and the threadless sleeve portion 34 are a single, unitary piece. Preferably, the threadless sleeve portion 34 is extruded or cold stamped from the body 32. The second embodiment electrical fastener 30 further includes a bus bar 36 for electrically connecting, via a conventional connector body 38, the fastener 30 and one or more electrical wires 18 terminated in a mating connector 40 as shown in FIG. 4. The bus bar 36 is of a conventional C-shaped design.

In accordance with the scope of the present invention, a method for forming an electrical connection between the second embodiment electrical fastener 30, electrically connected to the electrical wires 18, and the electrically conductive surface 12 having the threaded peg 14 is disclosed. The steps of the method include: installing the threadless sleeve portion 34 of the electrical fastener 30 over the threaded peg 14 and into electrical contact with the electrically conductive surface 12; and crimping, riveting, or compressing the threadless sleeve portion 34 of the electrical fastener 30 to the threaded peg 14 of the electrically conductive surface 12 to hold the electrical fastener 30 against the electrically conductive surface 12.

In a vehicle application, typically the electrical fastener 30 is connected to the electrical connector 40, via the connector body 38, prior to delivery of the wire harness to the assembly plant. During assembly of the vehicle, an assembler typically places the electrical fastener 30 over the threaded peg 14 and into electrical contact with the vehicle sheet metal. The assembler then crimps the threadless sleeve portion 34 of the electrical fastener 30 to the threaded peg 14 with a tool known in the mechanical fastening applications described above.

Preferred embodiments of this invention have been disclosed, however, a worker of ordinary skill in the art would recognize that certain modifications would come within the scope of this invention. For that reason, the following claims should be studied to determine the true scope and content of this invention.

What is claimed is:

1. A method for forming an electrical connection between an electrical eyelet terminal, electrically connected to an electrical wire, and an electrically conductive surface having a threaded peg, the steps of the method comprising:

providing a threadless sleeve, wherein the sleeve includes a retaining lip;

providing a plurality of tabs on the eyelet terminal;

connecting the sleeve to the eyelet terminal by folding the tabs of the eyelet terminal over the retaining lip of the sleeve;

installing the connected sleeve and eyelet terminal over the threaded peg and into electrical contact with the electrically conductive surface; and crimping the sleeve to the threaded peg to hold the eyelet terminal against the electrically conductive surface.

2. An electrical fastener formed by the method of claim 1.

3. A method for forming an electrical connection between an electrical eyelet terminal, electrically connected to an electrical wire, and an electrically conductive surface having a threaded peg, the steps of the method comprising:

providing a threadless sleeve, wherein the sleeve is formed from a compressible material;

connecting the sleeve to the eyelet terminal;

installing the connected sleeve and eyelet terminal over the threaded peg and into electrical contact with the electrically conductive surface; and crimping the sleeve to the threaded peg to hold the eyelet terminal against the electrically conductive surface, wherein the step of crimping the sleeve to the threaded peg consists of compressing the sleeve against the threaded peg.

4. An electrical fastener formed by the method of claim 3.

5. A method for forming an electrical connection between an electrical eyelet terminal, electrically connected to an electrical wire, and an electrically conductive surface having a threaded peg, the steps of the method comprising:

providing a threadless sleeve connected to the eyelet terminal, wherein the sleeve and the eyelet terminal are formed as a single integral part;

installing the connected sleeve and eyelet terminal over the threaded peg and into electrical contact with the electrically conductive surface; and crimping the sleeve to the threaded peg to hold the eyelet terminal against the electrically conductive surface.

6. An electrical fastener formed by the method of claim 5.

* * * * *